US008695474B2

(12) United States Patent
Overbeek Bloem et al.

(10) Patent No.: US 8,695,474 B2
(45) Date of Patent: Apr. 15, 2014

(54) MUZZLE DEVICE AND METHOD OF TUNING THEREOF

(75) Inventors: Martin Ferdinand Overbeek Bloem, Campbell, CA (US); Edward Alan Normandy, South San Francisco, CA (US)

(73) Assignee: Battle Comp Enterprises, LLC, South San Francisco, CA (US)

( * ) Notice: Subject to any disclaimer, the term of this patent is extended or adjusted under 35 U.S.C. 154(b) by 223 days.

(21) Appl. No.: 13/048,759

(22) Filed: Mar. 15, 2011

(65) Prior Publication Data

US 2011/0271575 A1 Nov. 10, 2011

Related U.S. Application Data

(60) Provisional application No. 61/343,941, filed on May 6, 2010.

(51) Int. Cl.
*F41A 21/38* (2006.01)

(52) U.S. Cl.
USPC ..... 89/14.3; 89/14.2

(58) Field of Classification Search
USPC ..... 89/14.3, 14.1, 14.4; 181/223
See application file for complete search history.

(56) References Cited

U.S. PATENT DOCUMENTS

| | | | | |
|---|---|---|---|---|
| 812,140 | A | 2/1906 | Kent | |
| 2,206,567 | A | 7/1940 | Hughes | |
| 2,212,683 | A | 8/1940 | Hughes | |
| 2,667,815 | A | 2/1954 | Strong | |
| 3,971,285 | A | 7/1976 | Ellis et al. | |
| 4,291,610 | A * | 9/1981 | Waiser | 89/14.4 |
| D280,655 | S | 9/1985 | Cellini | |
| 4,583,445 | A | 4/1986 | Blair | |
| D285,238 | S | 8/1986 | Cellini | |
| D296,350 | S | 6/1988 | Cellini | |
| D300,763 | S | 4/1989 | Mazzanti | |

(Continued)

FOREIGN PATENT DOCUMENTS

| | | | |
|---|---|---|---|
| KR | 10-0262834 | B1 | 8/2000 |
| WO | WO 2011/140474 | A2 | 11/2011 |

OTHER PUBLICATIONS

PCT/US11/35571 International Search Report and Written Opinion dated Feb. 8, 2012.

(Continued)

*Primary Examiner* — Daniel J Troy
(74) *Attorney, Agent, or Firm* — K&L Gates LLP

(57) ABSTRACT

A muzzle device for simultaneously mitigating the four major physical effects caused when a projectile is fired; muzzle climb, concussion, and recoil without an increased muzzle flash signature is provided. The muzzle device can include a cylindrical body defining an expansion chamber and can include a securing mechanism arranged at a proximal end and an end wall arranged at a distal end. An opening sized for a projectile can be arranged in the distal end wall. At least one distal tuning vent can be arranged in the distal end wall about the opening. A plurality of radial exhaust vents can be arranged through a cylindrical wall of the cylindrical body. The expansion chamber can define a fixed volume and the tuning and exhaust vents can define an open area. A ratio between the fixed volume and the open area can be about 0.6 to 1 to about 0.9 to 1. A method of tuning a muzzle device is also provided.

12 Claims, 8 Drawing Sheets

(56) References Cited

U.S. PATENT DOCUMENTS

| | | | | |
|---|---|---|---|---|
| 4,879,942 | A | 11/1989 | Cave | |
| 4,945,812 | A | 8/1990 | Mazzanti | |
| 5,063,827 | A * | 11/1991 | Williamson | 89/14.3 |
| 5,092,223 | A | 3/1992 | Hudson | |
| 5,811,714 | A | 9/1998 | Hull et al. | |
| 5,844,162 | A | 12/1998 | Renner | |
| 6,112,447 | A | 9/2000 | Androsov | |
| 6,722,254 | B1 | 4/2004 | Davies | |
| 6,752,062 | B2 | 6/2004 | Vais | |
| 6,820,530 | B2 * | 11/2004 | Vais | 89/14.3 |
| 7,207,255 | B2 | 4/2007 | Felton | |
| 7,594,464 | B2 | 9/2009 | Dueck | |
| D605,724 | S | 12/2009 | Heath | |
| 7,870,815 | B2 * | 1/2011 | Hung | 89/14.2 |
| 8,042,448 | B1 | 10/2011 | Sylvester et al. | |
| 8,322,266 | B2 * | 12/2012 | Presz et al. | 89/14.4 |
| 2002/0112602 | A1 | 8/2002 | Champion | |
| 2003/0106416 | A1 | 6/2003 | Vais | |
| 2003/0136251 | A1 | 7/2003 | Rosenthal | |
| 2004/0244571 | A1 | 12/2004 | Bender | |
| 2005/0066803 | A1 | 3/2005 | Rosenthal | |
| 2005/0252365 | A1 | 11/2005 | Balbo et al. | |
| 2006/0048639 | A1 | 3/2006 | Felton et al. | |
| 2008/0083321 | A1 | 4/2008 | Dueck et al. | |
| 2011/0297477 | A1 * | 12/2011 | Koumbis | 181/223 |
| 2012/0180624 | A1 * | 7/2012 | Troy et al. | 89/14.4 |

OTHER PUBLICATIONS

PCT/US11/35571 International Preliminary Report on Patentability dated Nov. 6, 2012 and Written Opinion dated Feb. 8, 2012.

* cited by examiner

MUZZLE DEVICE AND METHOD OF TUNING THEREOF

CROSS REFERENCE TO RELATED APPLICATION

The present application claims the benefit from earlier filed U.S. Provisional Patent Application No. 61/343,941, filed May 6, 2010, which is incorporated herein in its entirety by reference.

FIELD OF THE INVENTION

The present teachings relate to a muzzle device for firearms and a method of tuning a muzzle device. In particular, the present teachings relate to a muzzle device for the muzzle end of a firearm that can simultaneously mitigate the four major physical effects caused when a projectile is fired; muzzle climb, concussion, and recoil without an increased muzzle flash signature.

BACKGROUND OF THE INVENTION

Currently known muzzle devices can effectively address only one or two of the four major physical effects caused when a projectile is fired. For example, if a particular muzzle device has structural properties which provide a significant reduction in muzzle climb those same properties result in an unwanted amount of muzzle flash.

Accordingly, there exists a need for a muzzle device that can address all four of the critical force reactions when a projectile is fired in a balanced approach. There also exists a need for a muzzle device that is adaptable to all current device attachments based on the A2 flash hider currently used by the military and law enforcement while also being scalable for use on a variety of other calibers.

SUMMARY OF THE INVENTION

The present teachings provide a muzzle device including a cylindrical body defining an expansion chamber. A securing mechanism can be arranged at a proximal end of the muzzle device and an end wall can be arranged at a distal end. An opening sized for a projectile can be arranged in the distal end wall. At least one distal tuning vent can be arranged in the distal end wall about the opening and a plurality of radial exhaust vents can be arranged through a cylindrical wall of the cylindrical body. The expansion chamber can define a fixed volume and the tuning and exhaust vents can define an open area. A ratio between the fixed volume and the open area can be about 0.6 to 1 to about 0.9 to 1.

The present teachings further provide a muzzle device including a cylindrical body defining an expansion chamber. A securing mechanism can be arranged at a proximal end of the cylindrical body. An end wall arranged at a distal end of the cylindrical body can have a concave-shaped axial end face. An opening sized for a projectile can be arranged in the distal end wall. At least one distal tuning vent can be arranged in the distal end wall about the opening. A plurality of radial exhaust vents can be arranged in a cylindrical wall of the cylindrical body. The plurality of radial exhaust vents are arranged in longitudinally extending rows on the cylindrical wall. Each longitudinally extending row of radial exhaust vents can include at least two radial exhaust vents.

The present teachings still further describe a muzzle device including a cylindrical body defining an expansion chamber. A securing mechanism can be arranged at a proximal end of the cylindrical body. An end wall can be arranged at a distal end of the cylindrical body and can include an opening sized for a projectile. A plurality of radial exhaust vents can be arranged in a cylindrical wall of the cylindrical body. The expansion chamber can be defined by an inner circumferential surface of the cylindrical body, an inner face of the distal end wall, and an inner face of an oppositely arranged proximal end wall which forms a funnel shape at an entrance to the expansion chamber.

The present teachings yet further describe a method of tuning a muzzle device including providing a cylindrical body defining an expansion chamber and including a securing mechanism arranged at a proximal end and an end wall arranged at a distal end. The method includes forming an opening sized for a projectile in the distal end wall, forming a plurality of radial exhaust vents through a cylindrical wall of the cylindrical body, and forming at least one distal tuning vent in the distal end wall about the opening, the at least one distal tuning vent including an open area. The method further includes varying the size of the open area of the at least one distal tuning vent until a balance is achieved between at least two of a muzzle rise control property, a flash mitigation property, a recoil control property, and a concussion property.

Additional features and advantages of various embodiments will be set forth, in part, in the description that follows, and will, in part, be apparent from the description, or may be learned by the practice of various embodiments. The objectives and other advantages of various embodiments will be realized and attained by means of the elements and combinations particularly pointed out in the description herein.

It is to be understood that both the foregoing general description and the following detailed description are exemplary and explanatory only, and are intended to provide an explanation of various embodiments of the present teachings.

DETAILED DESCRIPTION OF THE PREFERRED EMBODIMENTS

The present teachings relate to a muzzle device that is intended to be attached to the muzzle end of a firearm for use by sportsmen, military personnel, law enforcement personnel, and others. The muzzle device of the present teachings can be mounted upon a high-powered rifle but the device can also provide advantages when used with other types of firearms. The muzzle device is useable in the field to control the forces and concussion present at the muzzle end of the firearm when a round is expelled from the end of the barrel.

Figure 1:
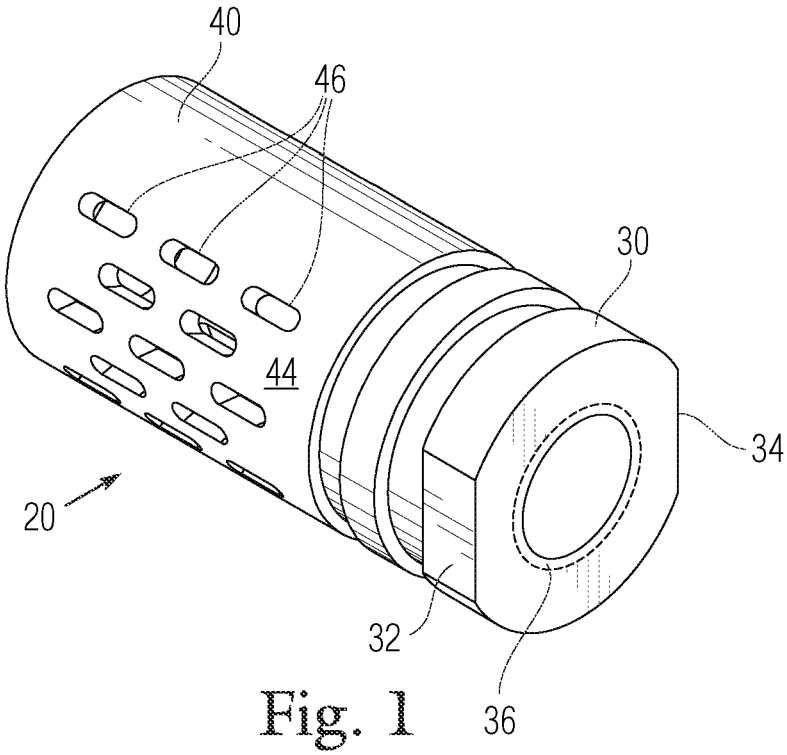
FIG. 1 shows a perspective view of the muzzle device according to a first embodiment with the proximal end at the rightmost portion of the drawing and the distal end at the leftmost end.

Referring to FIG. 1, the muzzle device 20 of the present teachings can include a cylindrical body having a proximal end 30 which can include a securing mechanism for coupling the muzzle device 20 directly to the muzzle end of a firearm. The securing mechanism can include a threaded end 36 for threaded attachment to a firearm barrel. For example, the threaded end 36 can include a threaded attachment through a ½-28 UNEF standard thread as used on the AR-15, M4, M-16 and any other 5.56 mm/.223 caliber firearms. Attachment using the threaded end 36 to various other caliber firearms can be readily accommodated through a change of thread pitch and hole diameter at the threaded end 30. Alternatively, the muzzle device 20 can be coupled to a firearm barrel by way of any other mechanism, such as by welding, any mechanical locking system, or by being machining directly onto the muzzle end of the firearm.

Figure 2:
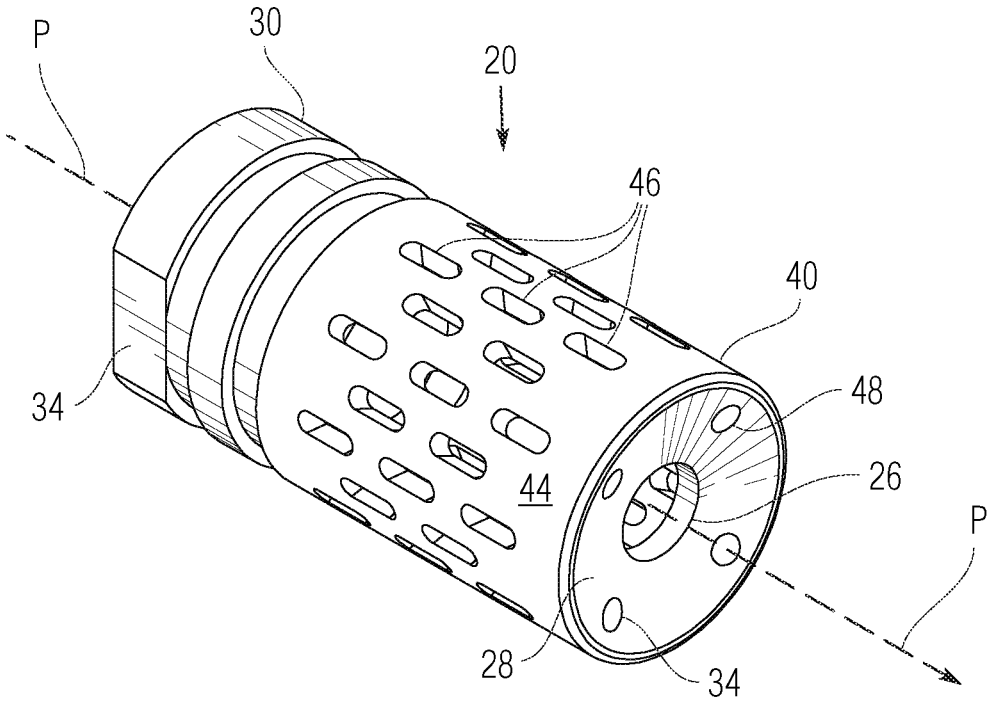
FIG. 2 shows a reversed perspective view of the muzzle device of FIG. 1 with the distal end at the rightmost portion of the drawing and the proximal end at the leftmost end.

Referring to FIG. 2, a projectile traveling along a path P can enter the muzzle device 20 at the left side corresponding to the proximal end 30. After entering the muzzle device 20, the projectile travels through an internal vented passageway formed within the cylindrical body of the muzzle device 20. The projectile then exits the muzzle device 20 through an opening 26 formed in a concave-shaped axial end face 28 situated at the distal end 40 of the muzzle device 20. The diameter of the opening is sized to the particular caliber of the firearm so as to allow sufficient clearance for the projectile in addition to ensuring the muzzle device 20 does not affect accuracy.

Figure 3:
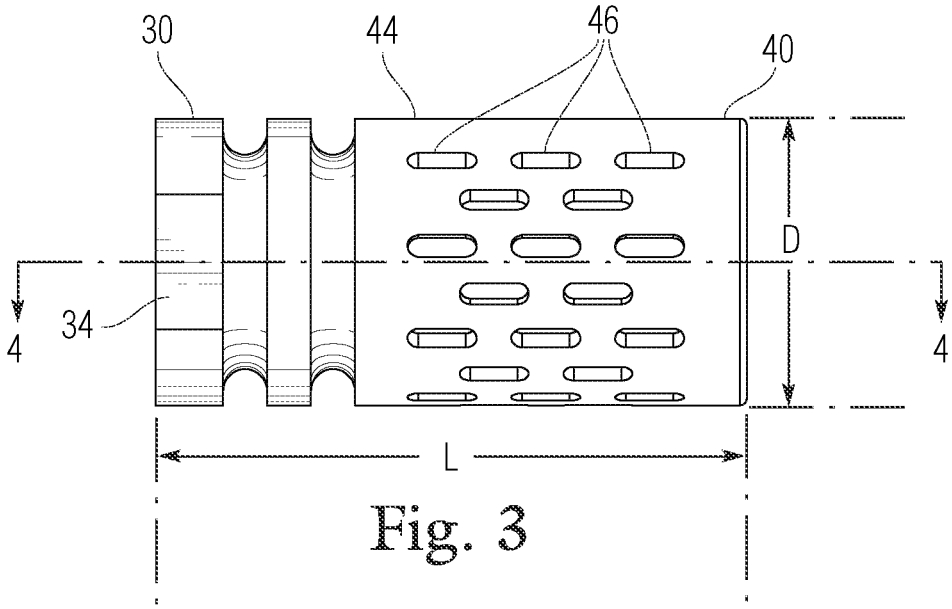
FIG. 3 shows a side view of the muzzle device according to the first embodiment.
Figure 4:
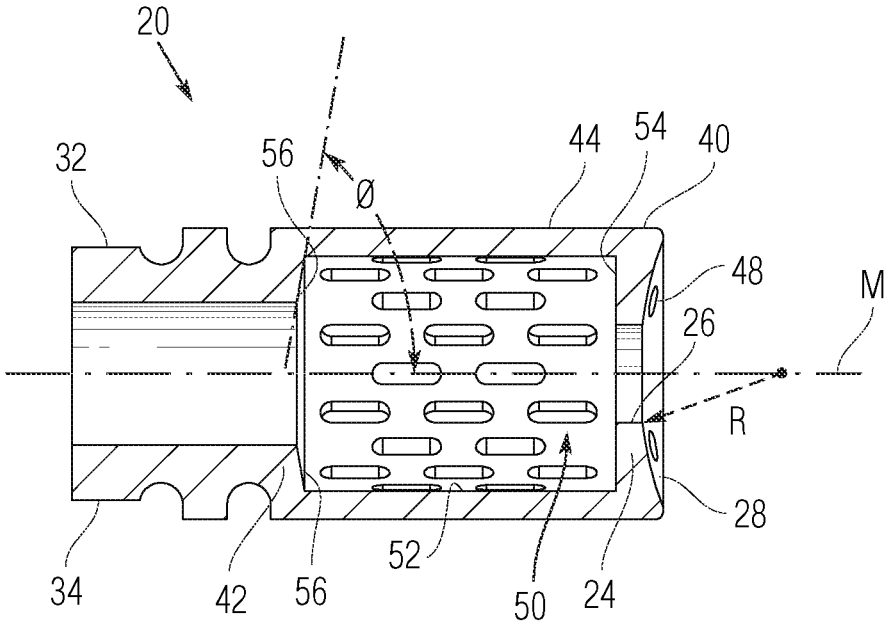
FIG. 4 shows a cross-section taken through section 3-3 of the muzzle device of FIG. 3.

Referring now to FIGS. 3 and 4, the cylindrical body of the muzzle device 20 can include an elongated cylindrical wall 44 having a plurality of radial exhaust vents 46 extending through the entire thickness of the cylindrical wall 44. A distal end wall 24 can be arranged at the distal end 40 of the elongated cylindrical wall 44. The distal end wall 24 can include an inner face 54 and an axial end face 28. The axial end face 28 can be formed with a concave shape. The concave shape can be defined by a radius of curvature, R, as measured from the longitudinal axis, M, of the muzzle device 20. At least one distal tuning vent 48 can extend through the distal end wall 24 and exit from the axial end face 28. The distal tuning vents 48 can be spaced about the opening 26 in the axial end face 28. According to an exemplary embodiment, four distal tuning vents 48 can be arranged about the opening 26. However, any number of distal tuning vents 48 can be implemented depending on the shape and location of all of the vents, ballistics of the cartridge, and the configuration of the firearm.

As shown in FIG. 4, an expansion chamber 50 is formed within the cylindrical body of the muzzle device 20. The expansion chamber 50 is defined by a circumferential inner surface 52 of the generally cylindrical wall 44, the inner face 54 of the distal end wall 24, and an inner face 56 of an oppositely arranged proximal end wall 42. The inner face 56 can be defined by a funnel shape forming an entrance to the expansion chamber 50. For example, the funnel shape can be formed by an angled surface at the inner face 56 which forms an acute angle, θ, with respect to a longitudinal axis, M, of the muzzle device 20.

According to various embodiments, the angled surface of the inner face 56 can form a relatively small angle with respect to a longitudinal axis, M, such that the entrance funnel can run down up to an entire length of the expansion chamber 50 to the distal end 40. In such an arrangement, for example, the angle, θ, can be as little as about 20°. As the funnel runs down the length of the expansion chamber 50 some or all of the radial exhaust vents 46 can extend through the inner face 56.

The expansion chamber 50 can be vented by the radial exhaust vents 46 and by the distal tuning vents 48. Upon the firing of a bullet, the firearm's combustion gases follow the bullet through the barrel and proceed through the proximal end 30 of the muzzle device 20 into the expansion chamber 50. The expansion chamber 50 is sized and shaped to control gas flow speed, direction, and expansion rate based upon the shape and location of the vents, ballistics of the cartridge, and the configuration of the firearm to be used.

More particularly, the expansion chamber 50 provides a controlled environment which smoothly slows down the gas jet upon entry into the expansion chamber 50 and gradually reduces the pressure spike (i.e. provides a controlled expansion) as the bullet leaves the opening 26 at the axial end face 28. The funnel shape of the inner face 56 of the proximal end wall 42 operates to achieve a smooth transition from a supersonic gas flow to a trans-sonic gas flow within the expansion chamber 50. As will be discussed below, muzzle rise can be controlled by directing the gas flow smoothly in a generally laminar fashion through the expansion chamber 50.

When the gas impacts the inner face 54 of the distal end wall 24, a small amount of turbulence is created which breaks up the substantially laminar flow of the gas. At the same time, the shape, arrangement, and size of the radial exhaust vents 46 operate as a screen to chop-up the gas as it radially exits from the expansion chamber 50. The creation of turbulence within the expansion chamber 50 and the chopping-up of the radially exiting gas operate to mitigate the muzzle flash created by the firearm. The expansion chamber 50 and radial exhaust vents 46 also operate to trap the acoustical signature which results in the mitigation of concussion.

After striking the distal end wall 24, a portion of the combustion gas within the combustion chamber 50 is directed outwards and upwards through the radial exhaust vents 46. By smoothly directing the gas flow through the expansion chamber 50 and then efficiently venting the gas through the radial exhaust vents 46, a significant downward force can be directed on the muzzle which can mitigate muzzle rise and recoil forces.

The axially arranged distal tuning vents 48 as shown in FIGS. 1 and 4 can be used to mitigate the recoil force on the firearm by balancing the volume of gas flowing radially through the radial exhaust vents 46 with the volume of gas flowing axially through the distal tuning vents 48 (i.e. in the forward direction). This balancing can be achieved through adjusting the volume of flow through the distal tuning vents 48 by varying their open area. By allowing more or less gas to escape axially through the distal tuning vents 48 by adjusting their total open area, the amount of radial muzzle flash can be tuned without significantly effecting muzzle rise. More particularly, the size of the open area of at least one distal tuning vent 48 can be varied until a balance is achieved between at least two of a muzzle rise control property, a flash mitigation property, a recoil control property, and a concussion property, and preferably between all four properties. As shown, the concave-shaped axial end face 28 can include four distal tuning vents 48 but any number can be used to tune the gas flow and pressure in the expansion chamber 50.

Moreover, since the distal tuning vents 48 exit from a concave-shaped axial end face 28, the portion of the gas flowing through the radial-most part of a respective tuning vent 48 is in contact with the wall of the vent the longest. This forces the gas to curve inwardly upon exit from the tuning vent 48. As the gas exits and curves inwardly from each of the distal tuning vents 48, the muzzle flash becomes focused in the axial direction.

In summation, muzzle flash can be mitigated by breaking up the gas in the expansion chamber 50 while muzzle rise can be controlled by directing the gas flow in a smooth, laminar fashion through the expansion chamber 50. As explained above, these two physical effects have exactly opposite requirements. However, the design of the muzzle device 20 of the present teachings strikes a balance by allowing the optimization of the shape and volume of the expansion chamber 50 in relation to the location, size, and number of radial exhaust vents 46 and distal tuning vents 48.

As with the distal tuning vents 48, any number of radial exhaust vents 46 can be implemented depending on the shape and location of all of the vents, ballistics of the cartridge, and the configuration of the firearm. For example, the radial exhaust vents 46 can be substantially equal-sized and arranged in a generally symmetrical pattern on the cylindrical wall 44 of the muzzle device 20, as shown in FIGS. 1-4.

Figure 5:
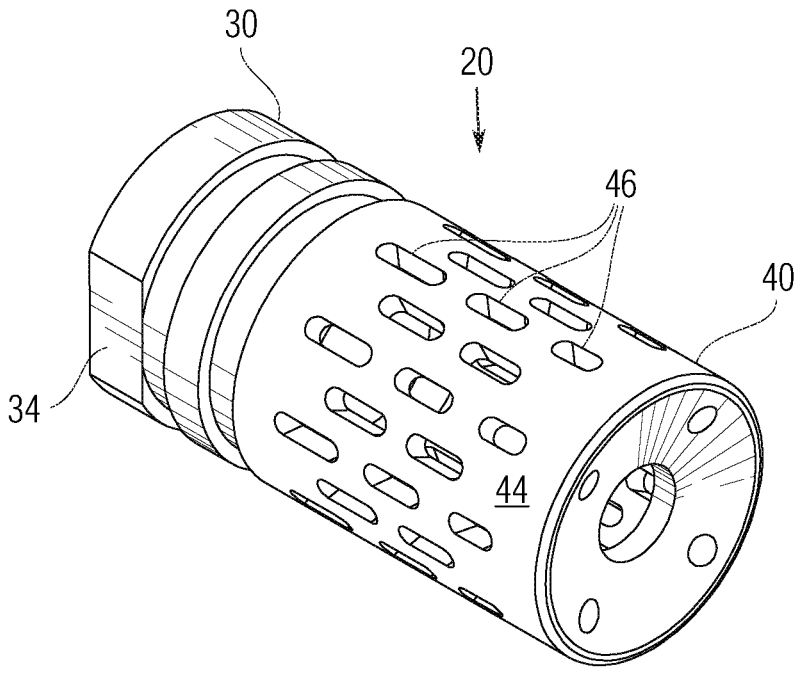
FIG. 5 shows a perspective view of the muzzle device according to the first embodiment including progressively sized radial exhaust vents.

As shown in FIG. 5, progressive sizing of the radial exhaust vents 46 can also be implemented. In progressive sizing, the individual radial exhaust vents 46 at the proximal end 30 of the muzzle device 20 can have the largest open area and the individual radial exhaust vents 46 at the distal end 40 can have the smallest open area. Moreover, the individual open area of each radial exhaust vent 46 can progressively decrease when moving from the proximal end 30 to the distal end 40 of the muzzle device 20. The decrease in size of the radial exhaust vents 46 can occur linearly or non-linearly when moving from the proximal end 30 to the distal end 40. Such progressive sizing of the radial exhaust vents 46 can help to even out the gas flow as it exits through the radial exhaust vents 46 along the length of the expansion chamber 50. Since the combustion gases flow into the expansion chamber 50 and then impact the inner face 54 of the distal end wall 24 and reverse direction, by constricting the distal vents and then gradually opening up the preceding vents, the gas flow radially out of the expansion chamber 50 can become more evenly spread out across the length of the muzzle device 50 so all of the radial exhaust vents 46 can work more efficiently. The progressive sizing of the radial exhaust vents 46 can result in further mitigation of muzzle rise and flash.

The radial exhaust vents 46 can be arranged in longitudinally extending rows, with each row being separated by an equal separating distance there between, thereby providing even spacing between rows in a circumferential direction. The spacing of individual radial exhaust vents 46 between neighboring rows can be staggered as shown in FIGS. 1-4. Such staggering can improve the structural rigidity of the muzzle device 20. The details of the shape, arrangement, and size of the radial exhaust vents 46 will be discussed more fully below.

The vent pattern of the radial exhaust vents 46 can be arranged so as to symmetrically cover a sector which extends over a large portion of the cylindrical wall 44, such as about 320°, while leaving the remaining portion of the wall solid or non-vented. When the muzzle device 20 of the present teachings is properly installed on the muzzle end of a firearm barrel, the middle row of radial exhaust vents 46 (or the mid-point of the sector defining the radial exhaust vents) is arranged at the twelve o'clock (or top-dead-center) position of the barrel 22. This leaves the solid or non-vented portion of the cylindrical wall 44 facing downwardly which operates to mitigate downward dust blast. Moreover, as discussed previously above, when the muzzle device 20 is installed in the proper circumferential position, the generally upwardly facing radial exhaust vents 46 force the combustion gases outwards and upwards creating the downward force on the muzzle which counteracts muzzle rise and recoil.

As shown in FIGS. 1, 2 and 4, the proximal end 30 of the muzzle device 20 can include two flat surfaces 32, 34 which are arranged generally perpendicularly to the main cylindrical body of the muzzle device 20. The flat surfaces 32, 34 allow the use of a standard AR armorer's tool or the use of a ¾" open-ended wrench for threaded attachment. The orientation of the flat surfaces 32, 34 ensures correct timing of the muzzle device 20 on the muzzle end with the non-vented section being oriented to the ground when the wrench is horizontal to the Y-axis and the flat surfaces 32, 34 are extending about 90° to the Y-axis.

Figure 6:
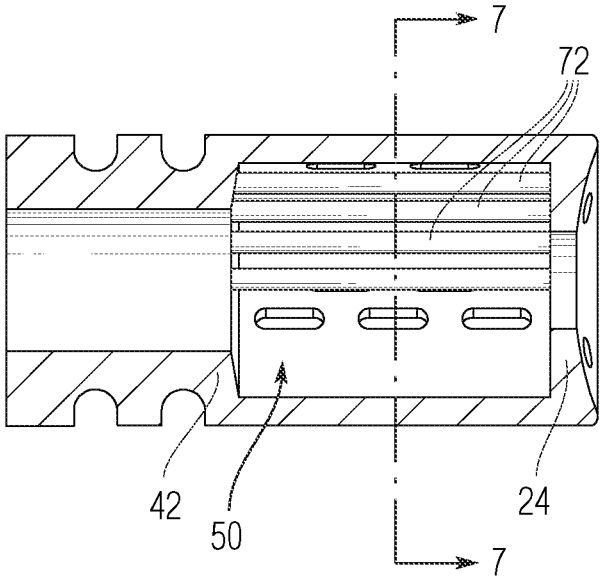
FIG. 6 shows a cross-sectional side view of the muzzle device according to the first embodiment including an internal flow modifier structure.
Figure 7:
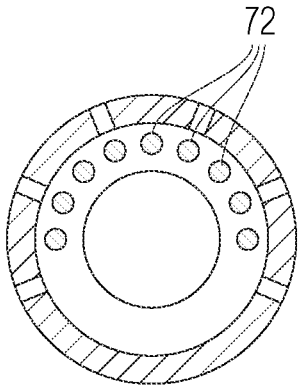
FIG. 7 shows a cross-sectional end view taken through section 7-7 of FIG. 6.

According to various embodiments, the radial gas flow within the expansion chamber 50 in the direction of the radial exhaust vents 46 can be controlled by internal flow modifiers to further mitigate muzzle flash. As shown in FIGS. 6 and 7, the internal flow modifiers can include a plurality of rods 72 which extend longitudinally across the expansion chamber 50. The longitudinally extending rods 72 can attach at one end to the proximal end wall 42 and attach at a second end to the distal end wall 24. The longitudinally extending rods 72 can be sequentially arranged in a circumferential direction within the expansion chamber 50 through the sector containing radial exhaust vents 46. The longitudinally extending rods 72 operate as obstructions for the gas flow which forces the gas to flow around the rods 72 in order for the gas to exit from the expansion chamber 50 through the radial exhaust vents 46.

Figure 8:
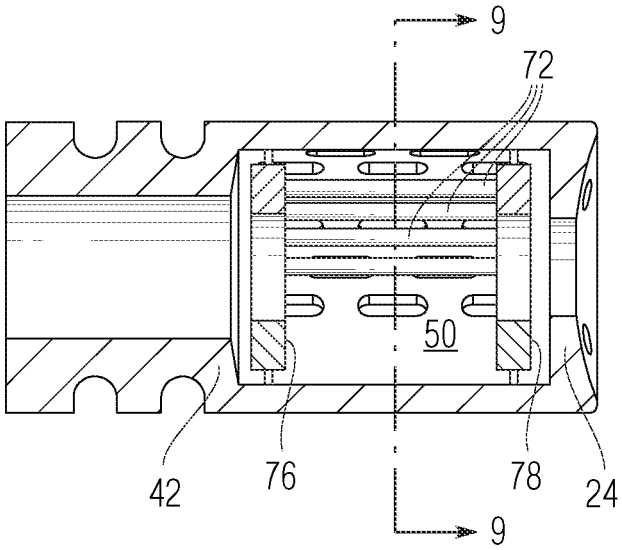
FIG. 8 shows a cross-sectional side view of the muzzle device according to the first embodiment including another internal flow modifier structure.
Figure 9:
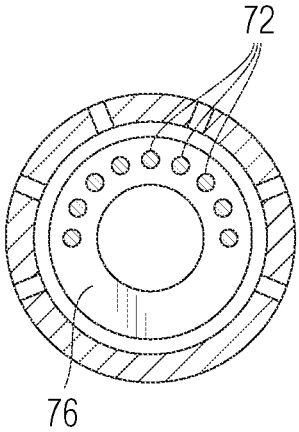
FIG. 9 shows a cross-sectional end view taken through section 9-9 of FIG. 8.

FIGS. 8 and 9 show another embodiment of internal flow modifiers in which the longitudinally extending rods 72 extend between a pair of supporting discs 76, 78. The rods 72 and supporting discs 76, 78 can be arranged as a separate assembly which can be slid into and securely held within the expansion chamber 50 of the muzzle device 20. The longitudinally extending rods 72 can be circumferentially positioned within the expansion chamber 50 so as to match-up with the sector containing the radial exhaust vents 46.

According to various embodiments, the internal flow modifiers can be any type of structure that can be arranged within the expansion chamber 50 that can control the flow through the expansion chamber 50 and the radial exhaust vents 46 in order to mitigate flash. For example, instead of rods 72, the internal flow modifier could include screening, square or rectangular-shaped bars, perforated sheet, and the like. Moreover, the internal flow modifiers can be inserts of a mechanical nature, machined-in features, a dynamic internal mechanism, or a combination thereof.

By sizing the expansion chamber 50 in relation to the size, spacing, and shapes of the radial exhaust vents 46 and by tuning the expansion chamber 50 by way of the size, spacing, and shapes of the distal tuning vents 48, the muzzle device 20 of the present teachings can operate to simultaneously mitigate the four major physical effects caused when a projectile is fired; including muzzle climb, concussion, recoil, and muzzle flash signature. The sizing of the expansion chamber 50, the radial exhaust vents 46, and the distal tuning vents 48 can be carefully tuned in an integrated manner to reach the optimized balance point where the four major physical effects mentioned above are simultaneously mitigated. For each caliber of firearm, the size, spacing, and shape of the features of the muzzle device 20 can be unique based on integrated dimensional tuning to achieve the optimized balance point for the four major physical effects.

FIGS. 1-4 will now be referenced to describe the specifics of an exemplary embodiment of the muzzle device 20 of the present teachings that has been optimized for the gas volume displaced by a 5.56 mm/.223 caliber cartridge.

In this optimized design, the longitudinally extending rows of radial vents 46 are arranged in an alternating configuration of three equal-sized radial vents per row and two equal-sized radial vents per row. The separating distance between each radial vent in a respective longitudinal row can be about 0.100". The muzzle device 20 can include a total of fifteen longitudinal rows of radial exhaust vents 46, with seven rows of two vents per row arranged between eight rows of three vents per row. Moreover, the circumferential separation distance between each row of radial vents can be about 0.100". This results in the muzzle device 20 including thirty-eight radial exhaust vents 46.

According to this exemplary embodiment, each of the thirty-eight radial exhaust vents 46 can have the shape of an elongated oval so as to be about 0.065" wide and about 0.140" long. Including the rounded ends, the area of each radial exhaust vent 46 can be about 0.012 $in^2$. When thirty-eight radial exhaust vents 46 are implemented, a total radial exhaust vent opening area is about 0.798 $in^2$.

Each of the four distal tuning vents 48 can have a diameter of about 0.089" and can be equally spaced about 90° apart. This provides a total distal tuning vent opening area of about 0.025 $in^2$.

The length of the expansion chamber 50 can be about 0.922 in. while the inside diameter can be about 0.694 in., thereby providing a total optimized volume for the expansion chamber 50 of about 0.616 $in^3$. Moreover, the peripheral wall thickness of the expansion chamber 50 can be about 0.078 in. with a distal end wall 24 thickness of about 0.078 in. at its thinnest point. The concave shaped axial end face 28 can be defined by a 1.0 in. radius of curvature, R, as measured from the longitudinal axis, M, of the muzzle device 20. According to various embodiments, the value of the acute angle, θ, can preferably be about 70° to about 85°, and most preferably about 80°.

Also according to this exemplary embodiment, the external dimensions of the muzzle device 20 can include an overall length, L, of about 1.750 in. and a major outside diameter, D, of about 0.863 in. This can result in a muzzle device 20 having a relatively low mass. The exterior dimensions and the general contour of the muffle device 20 of the present teachings can be intended to minor those of a standard A2 flash hider so as to allow compatibility with current special use devices, such as certain suppressors. The package footprint of the muzzle device 20 can generally be minimized for weight and length.

In summation, for the gas volume displaced by a 5.56 mm/.223 caliber cartridge, the optimized volume for the expansion chamber 50 can be about 0.616 $in^3$ while the optimized total vent area is about 0.823 $in^2$.

The design of the muzzle device 20 of the present teachings is scalable for use with other caliber cartridges based on the chamber volume and the total vent area. The size, shape, and arrangement of the radial exhaust vents 46 and the distal tuning vents 48 can be varied in order to address the various caliber cartridges and firearm platforms. For example, the larger the caliber, the larger the expansion chamber and the larger the total volume of the exhaust vents. The muzzle device 20 can be scalable up to any commercially available caliber up to at least 0.50 and above.

Figure 10:
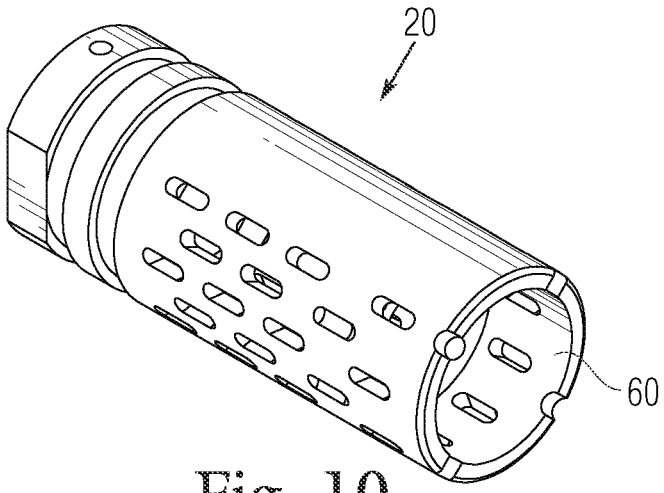
FIG. 10 shows a perspective view of the muzzle device according to a second embodiment with the distal end at the rightmost portion of the drawing and the proximal end at the leftmost end.
Figure 11:
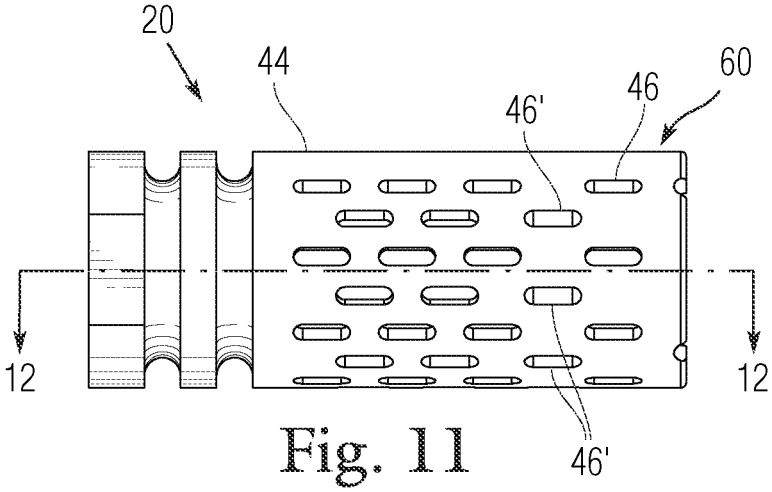
FIG. 11 shows a side view of the muzzle device according to the second embodiment.
Figure 12:
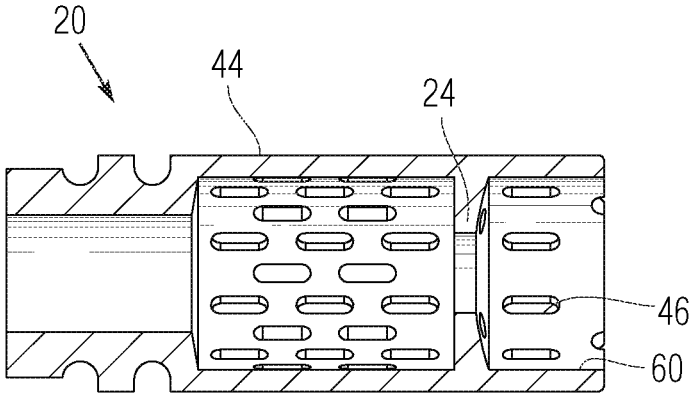
FIG. 12 shows a cross-section taken through section 12-12 of the muzzle device of FIG. 11.

Referring now to FIGS. 10-12, a further embodiment of the muzzle device 20 of the present teachings is shown. As best shown in FIGS. 10 and 12, the muzzle device 20 can include a lengthened hood 60 extending from the distal end of the muzzle device 20. The lengthened hood 60 is formed by a continuation of the cylindrical wall 44 beyond the axial end face 28. The lengthened hood 60 operates to mitigate the flash signature of the muzzle device 20. Moreover, the lengthened hood 60 can lengthen the barrel of the firearm so as to reach a minimum length requirement as required by any particular laws.

The portion of the cylindrical wall 44 making up the lengthened hood 60 can include radial exhaust vents 46 extending through the thickness of the lengthened hood 60. Moreover, additional radial exhaust vents 46' can be arranged to extend through the cylindrical wall 44 and to straddle over both faces of the distal end wall 24. The muzzle device 20 of FIGS. 10-12 can include longitudinally extending rows of radial exhaust vents 46 arranged in an alternating configuration of four radial vents per row and three radial vents per row. As shown, in each row the distance between at least two of the radial exhaust vents 46 can be unequal. In the exemplary embodiment shown, the muzzle device 20 can include a total of fifteen longitudinal rows of radial exhaust vents 46, with seven rows of three radial vents per row arranged between eight rows of four radial vents per row.

When optimized for the gas volume displaced by a 5.56 mm/.223 caliber cartridge, the lengthened hood 60 of the muzzle device 20 of FIGS. 1-4 can increase the length of the muzzle device 20 to about 2.150 in., which is an extra 0.400 in. beyond the length of the muzzle device 20 discussed above. As such, the muzzle device 20 having the lengthened hood 60 can be used with a firearm having a 14.5 in. barrel in order to reach a minimum length of 16.65 in. as required by law. The dimensions of the radial exhaust vents 46 and the distal tuning vents 48 (as well as the dimensions of the other features) can be similar to those for the muzzle device 20 as described in FIGS. 1-4 above. The unequal distance between the at least two radial exhaust vents 46 can be about 0.230 in.

Figure 13:
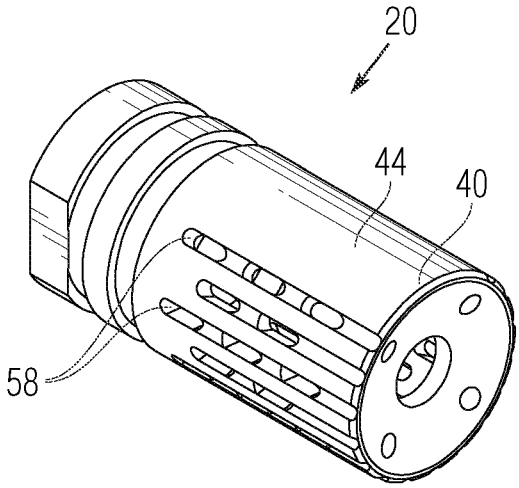
FIG. 13 shows a perspective view of the muzzle device according to a third embodiment with the distal end at the rightmost portion of the drawing and the proximal end at the leftmost end.
Figure 14:
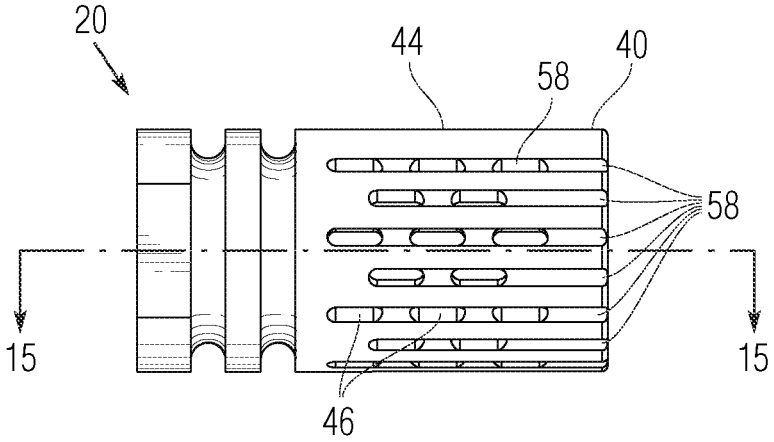
FIG. 14 shows a side view of the muzzle device according to the third embodiment.
Figure 15:
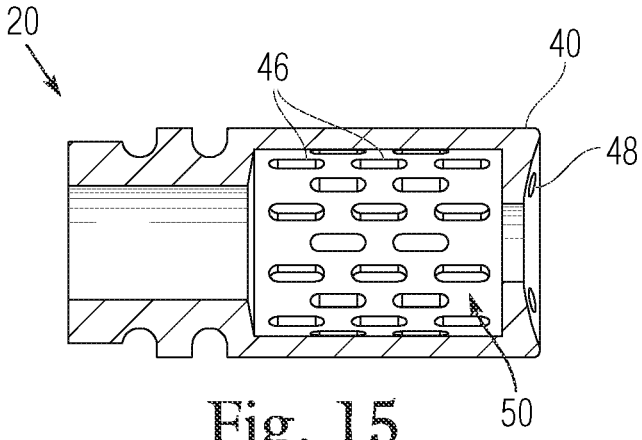
FIG. 15 shows a cross-section taken through section 15-15 of the muzzle device of FIG. 14.

Referring now to FIGS. 13-15, a further embodiment of the muzzle device 20 of the present teachings is shown. The muzzle device 20 of FIGS. 13-15 is similar to the muzzle device 20 of FIGS. 1-4 and further includes a plurality of longitudinal slots or flutes 58 formed along the surface of the cylindrical wall 44. Each longitudinal slot 58 can extend along and connect the series of radial exhaust vents 46 which form a respective row of vents. When the muzzle device 20 is covered by a suppressor, the longitudinal slots 58 operate to provide a path for gas to be radially expelled from the expansion chamber 50 and to axially flow and eventually exit from the distal end of the muzzle device 20. Moreover, the longitudinal slots 58 allow the muzzle device 10 to be fabricated more readily.

When optimized for the gas volume displaced by a 5.56 mm/.223 caliber cartridge, the muzzle device 20 of FIGS. 13-15 can include longitudinal slots or flutes 58. The longitudinal slots 58 can form a half circle having a diameter of about 0.065 in. The dimensions of the radial exhaust vents 46 and the distal tuning vents 48 (as well as the dimensions of the other features) can be similar to those for the muzzle device 20 as described in FIGS. 1-4 above.

Figure 16:
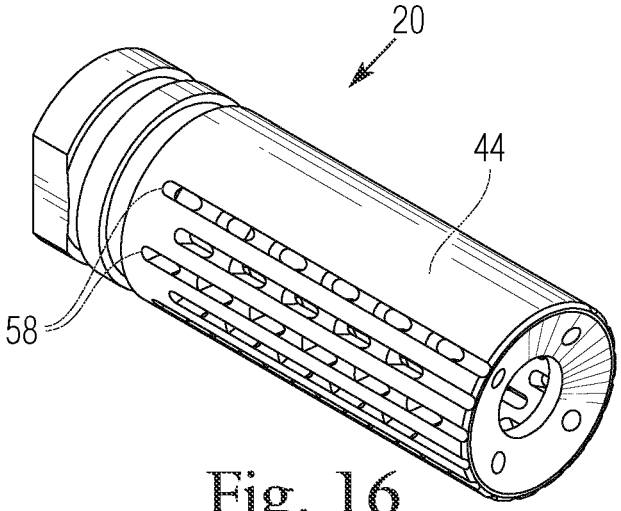
FIG. 16 shows a perspective view of the muzzle device according to a forth embodiment with the distal end at the rightmost portion of the drawing and the proximal end at the leftmost end.
Figure 17:
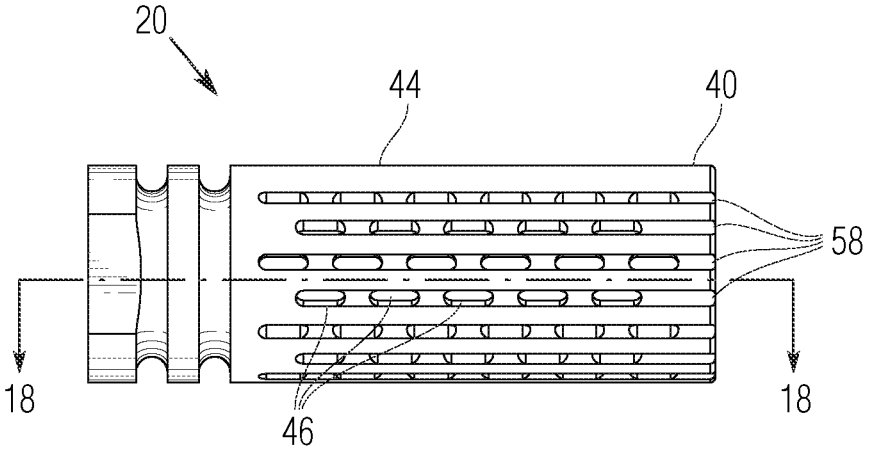
FIG. 17 shows a side view of the muzzle device according to the forth embodiment.
Figure 18:
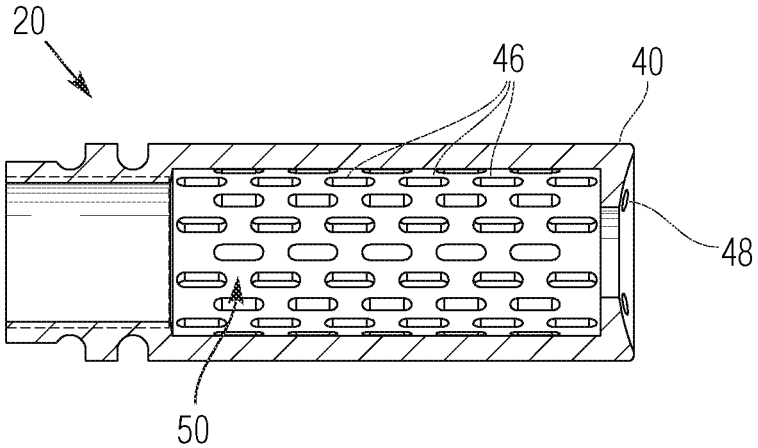
FIG. 18 shows a cross-section taken through section 18-18 of the muzzle device of FIG. 17.

Referring now to FIGS. 16-18, a yet further embodiment of the muzzle device 20 of the present teachings is shown. The muzzle device 20 of FIGS. 11-13 is an elongated version of the muzzle device 20 of FIGS. 8-10 with a plurality of longitudinal flutes or slots 58 formed along the surface of the cylindrical wall 44. In particular, the expansion chamber 50 has been elongated to have a length of about 1.772 in. and an inside diameter of about 0.694 in., thereby providing a volume of about 0.670 $in^3$. The longitudinal slots 58 can form a half circle having a diameter of about 0.065 in. As before, the peripheral wall thickness of the expansion chamber can be about 0.078 in. with a distal end wall 24 thickness of about 0.078 in. at its thinnest point.

The muzzle device 20 of FIGS. 16-18 can include eighty-three radial exhaust vents 46. In the exemplary embodiment shown, the muzzle device 20 can include a total of fifteen longitudinal rows of radial exhaust vents 46, with seven rows of five radial vents per row arranged between eight rows of six radial vents per row. The dimensions of the radial exhaust vents 46 and the distal tuning vents 48 can be similar to those for the muzzle device 20 as described in FIGS. 1-4 above. As such, the total radial exhaust vent opening area is about 0.996 $in^2$ and the total distal tuning vent opening area of 0.025 $in^2$.

In summation, the optimized volume for the expansion chamber 50 can be about 0.670 $in^3$ while the optimized total vent area is about 1.021 $in^2$.

The muzzle device 20 of the present teachings can be produced using a variety of machining techniques, including but not limited to, manual machining, CNC machining, casting, MIM, or molding. The muzzle device 20 can be finished using any known post-machining methods. Current materials used include stainless steel of various compositions, aluminum, and various other metals, such as polymers, composites, and the like. The design of the present teachings can be relatively easily and inexpensively produced from a single, unitary piece of bar stock. Multi-piece versions of the muzzle device 20 are also possible. For example, a version including separately inserted flow modifiers has been contemplated. The design of the muzzle device 20 provides flexibility so it can be scalable for use on various caliber firearms with simple dimensional changes and CNC programming.

The muzzle device 20 of the present teachings can simultaneously reduce recoil, concussion and muzzle rise without increasing muzzle flash. These advantages are achieved through the use of the sizing and shape of the expansion chamber, the tuned vent shapes, the vent patterns, and the open volume of the vents.

Those skilled in the art can appreciate from the foregoing description that the present teachings can be implemented in a variety of forms. Therefore, while these teachings have been described in connection with particular embodiments and examples thereof, the true scope of the present teachings should not be so limited. Various changes and modifications may be made without departing from the scope of the teachings herein.

What is claimed is:

1. A muzzle device comprising:

a cylindrical body defining an expansion chamber and including a securing mechanism arranged at a proximal end of the cylindrical body and a distal end wall arranged at a distal end of the cylindrical body, the distal end wall having an inner face forming an end wall of the expansion chamber and a concave-shaped axial outer face;

an opening for a projectile being arranged in the distal end wall;

four distal tuning vents being arranged in the distal end wall about the opening and passing from the expansion chamber through the inner face of the distal end wall and through the axial outer face of the end wall; and a plurality of radial exhaust vents being arranged through a cylindrical wall of the cylindrical body in longitudinally extending rows on the cylindrical body, each longitudinally extending row including at least two radial exhaust vents, each radial exhaust vent elongated parallel to its row;

wherein the radial tuning vents are arranged symmetrically around a center position of an upper sector of the cylindrical body, leaving a lower sector of the cylindrical body unvented; and wherein the four distal tuning vents are arranged in the axial outer face in a square pattern with about a 90 degree separation between distal tuning vents, the square pattern oriented with an uppermost two of the four distal tuning vents arranged symmetrically around the center position of the upper sector of the cylindrical body, no vents other than the four distal tuning vents being arranged in the distal end wall:

whereby when attached to a muzzle end of a firearm barrel with the center position of the upper sector of the cylindrical body oriented at the twelve o'clock position of the barrel, the muzzle device mitigates muzzle rise and recoil of the firearm during firing of the firearm.

2. The muzzle device of claim 1, wherein the expansion chamber defines a fixed volume and the tuning and radial exhaust vents define an open area and a ratio between the fixed volume and the open area is about 0.6 to 1 inches to about 0.9 to 1 inches.

3. The muzzle device of claim 1, wherein the muzzle device is an integral, one-piece structure.

4. The muzzle device of claim 2, wherein the ratio between the fixed volume and the open area is about 0.7 to 1 inches to about 0.8 to 1 inches.

5. The muzzle device of claim 1, wherein the total open area of the radial exhaust vents is about 0.8 $in^2$ to about 0.85 $in^2$.

6. The muzzle device of claim 1, wherein at least one of the plurality of radial exhaust vents is shaped as an elongated oval.

7. The muzzle device of claim 1, wherein the longitudinally extending rows of radial exhaust vents are arranged in alternating configurations of a different number vents per row.

8. The muzzle device of claim 1, wherein the open area of a radial exhaust vent near a proximal end of a longitudinally extending row of radial exhaust vents is larger than the open area of another radial exhaust vent near a distal end of the row.

9. The muzzle device of claim 8, wherein the open areas of the radial exhaust vents in a longitudinally extending row of radial exhaust vents progressively decrease along the row from the proximal end of the row to the distal end of the row.

10. The muzzle device of claim 1, comprising slots in the outer surface of the cylindrical wall arranged along the longitudinally extending rows of radial exhaust vents, each slot connecting radial exhaust vents in a corresponding row, the slots not penetrating through the cylindrical wall to the expansion chamber.

11. The muzzle device of claim 10, wherein the slots extend through the axial outer end face at the distal end of the cylindrical body.

12. The muzzle device of claim 1, wherein the muzzle device is a multi-piece structure.

* * * * *